US009470199B2

(12) United States Patent
Metral et al.

(10) Patent No.: US 9,470,199 B2
(45) Date of Patent: Oct. 18, 2016

(54) MULTI-CONTACTOR DEVICE FOR CONTROLLING ELECTRIC STARTER

(71) Applicant: VALEO EQUIPEMENTS ELECTRIQUES MOTEUR, Créteil (FR)

(72) Inventors: Jean-Sébastien Metral, La Verpilliere (FR); Tristan Guesney, Lyons (FR)

(73) Assignee: Valeo Equipments Electriques Moteur (FR)

( * ) Notice: Subject to any disclaimer, the term of this patent is extended or adjusted under 35 U.S.C. 154(b) by 2 days.

(21) Appl. No.: 14/367,170

(22) PCT Filed: Dec. 21, 2012

(86) PCT No.: PCT/FR2012/053036

§ 371 (c)(1),
(2) Date: Jun. 19, 2014

(87) PCT Pub. No.: WO2013/093365

PCT Pub. Date: Jun. 27, 2013

(65) Prior Publication Data

US 2014/0373801 A1 Dec. 25, 2014

(30) Foreign Application Priority Data

Dec. 22, 2011 (FR) ..... 11 62255

(51) Int. Cl.

| | |
|---|---|
| ***H01H 67/02*** | (2006.01) |
| ***F02N 11/08*** | (2006.01) |
| ***H01H 51/06*** | (2006.01) |
| ***H01H 50/54*** | (2006.01) |
| ***F02N 15/06*** | (2006.01) |
| *H01H 1/24* | (2006.01) |
| *H01H 9/42* | (2006.01) |

(52) U.S. Cl.

CPC ..... *F02N 11/0803* (2013.01); *F02N 11/08* (2013.01); *F02N 11/087* (2013.01); *F02N 11/0851* (2013.01); *F02N 15/067* (2013.01); *H01H 50/54* (2013.01); *H01H 51/065* (2013.01); *F02N 11/0814* (2013.01); *F02N 11/0844* (2013.01); *H01H 1/24* (2013.01); *H01H 9/42* (2013.01)

(58) Field of Classification Search

CPC ..... H01H 51/065; H01H 50/54; H01H 1/24; H01H 9/42; F02N 11/0851; F02N 11/0803; F02N 11/08

See application file for complete search history.

(56) References Cited

U.S. PATENT DOCUMENTS

| | | | | |
|---|---|---|---|---|
| 7,038,564 | B1 | 5/2006 | Kusumoto et al. | |
| 2002/0053961 | A1* | 5/2002 | Kajino | 335/126 |
| 2005/0184838 | A1* | 8/2005 | Niimi et al. | 335/126 |

FOREIGN PATENT DOCUMENTS

FR 2940719 7/2010

*Primary Examiner* — Bernard Rojas

(74) *Attorney, Agent, or Firm* — Berenato & White, LLC

(57) ABSTRACT

A starter for an internal combustion engine, comprising: an electric motor; a drive assembly including a pinion movable between a free position and a meshed position, wherein the pinion is rotatably linked to the electric motor and the internal combustion engine; an electric switching device including a main actuator capable, when engaged, of moving and holding a plunger, in position, the plunger being linked with the movement of the pinion between the free position and the meshed position, by means of a lever; a means connected to the plunger, which is capable of establishing electrical power contact between the electric motor and a power source when the pinion is in the meshed position; and including an auxiliary actuator capable, when engaged, of opening the power contact and a means for separately controlling the main actuator and the auxiliary actuator.

22 Claims, 6 Drawing Sheets

MULTI-CONTACTOR DEVICE FOR CONTROLLING ELECTRIC STARTER

CROSS-REFERENCE TO RELATED APPLICATIONS AND CLAIM TO PRIORITY

This application is a national stage application of International Application No. PCT/FR2012/053036 filed Dec. 21, 2012, which claims priority to French Patent Application No. 1162255 filed Dec. 22, 2011, of which the disclosures are incorporated herein by reference and to which priority is claimed.

FIELD OF THE INVENTION

The invention relates to a multi-contactor device, in particular for controlling an electric starter. More particularly but not exclusively, the invention is designed for controlling the electric starter of an internal combustion engine for a vehicle comprising a restarting device, commonly known as a restarter, which makes it possible to stop the functioning of the thermal engine by cutting off its fuel supply when the said engine is no longer participating in the propulsion of the vehicle, and to restart the said engine rapidly.

BACKGROUND OF THE INVENTION

According to an embodiment in the prior art, a starter comprises a launcher, which is mobile in translation and rotated by an electric motor. At its end, the launcher comprises a pinion which can engage with a toothed crown which is integral in rotation with (i.e., non-rotatably connected to) the crankshaft of the internal combustion engine. In order to start an internal combustion engine, it is necessary to increase its speed of rotation to approximately 200 rpm. According to the mode of use known in the prior art, the starter is used when the engine is at a standstill.

FIG. 1, which relates to the prior art, illustrates schematically an electric starter of this type, in its position of rest with the engine at a standstill. When a contact 110 is closed, power is supplied to a solenoid 120. This solenoid comprises a coil 121 known as a pull-in coil, and a coil 122 known as a hold-in coil. The power supplied to the solenoid 120 gives rise to the translation of a plunger 130. During this translation, the plunger 130 drives a pinion 160 of a launcher in translation by means of a fork, which is also known as a lever 161, which pinion 160 then engages with a crown 190 which is connected in rotation (i.e., non-rotatably) to the crankshaft of the engine. Thus, the plunger 130 and the pinion 160 are integral in translation according to this embodiment in the prior art. At the end of the course of the plunger 130, by means of a contact plate 131, the plunger establishes electrical contact between an armature 151 of an electric motor 150, and a positive terminal 101 of the vehicle battery. The electric motor 150 then rotates the pinion 160 of the launcher (as the electric motor 150 is non-rotatably connected to the pinion 160), which drives the crown 190 and launches the rotation of the internal combustion engine. In this position, with the contact plate 131 establishing the power circuit between a vehicle battery 100 and the armature of 151 the electric motor 150, the pull-in coil 121 is short-circuited, and the plunger is retained in position by the effect of the hold-in coil 122. When the contact 110 is open, the magnetic forces generated by the effect of the hold-in coil 122 and the pull-in coil 121. This is due to the fact that the direction of the current in the pull-in coil is inverted. In addition, when the contact 110 is open, a compression spring 132 thrusts the plunger 130 back, thus opening the contact previously established by the contact plate 131, and separating the pinion 160 from the crown 190. The connection in rotation (i.e., non-rotatable connection) of the pinion 160 to the electric motor 150 is provided by means of a free wheel mechanism 165, such that the pinion 160 is separated from the motor 150 when it is driven by the crown 190. This device according to the prior art gives satisfaction for the initial starting of the engine, when the engine is started by actuating the contact key, or by pressing a starter button.

The lever which is supported against a housing of the starter comprises play, known as the cut-off play 161, in order to allow the plate 131 to move away from the terminals in the case of an abnormality of the pinion blocked in the crown. The lever against the housing provides a pivot connection and translation perpendicular to the pivot.

Many vehicles are equipped with an automatic stop-restarting device known as "stop and go". According to this device, the internal combustion engine is cut-off automatically as soon as the vehicle is at a standstill, i.e. the running of the engine at idling speed is not maintained when the vehicle is at a standstill. When the driver is preparing to set off once more, for example when he presses the clutch, the engine is automatically restarted. This functioning mode makes it possible to save fuel in the phases where it is not necessary to have the engine running. Although this restarting is rapid, it is not instantaneous. In addition, according to the prior art, the fuel supply to the engine is also cut-off when the vehicle is in the engine brake situation, i.e. when the driver is not pressing the vehicle accelerator. According to the prior art, the cut-off of the supply to the thermal engine is continued until the engine reaches a predetermined speed corresponding for example to 1500 rpm, thus making it possible to maintain the supply to the engine in order to keep it running at least at idling speed, even if the said engine is not participating in the propulsion of the vehicle. In fact, it is considered that the internal combustion engine can no longer start autonomously in all situations, when its speed drops below a certain threshold of approximately 300 rpm. However, the starter according to the prior art, the functioning of which has previously been described, needs the engine to be at a standstill in order to begin to function, as a result of the balancing phase during which the starter cannot put its pinion into the crown. Thus, when a vehicle is equipped with a restarter device, it is necessary to detect that the thermal engine has actually stopped. The solutions according to the prior art thus lead to complex control of the system for stopping and restarting of the engine.

For example, the engine is not stopped, but is kept idling, for as long as the driver is exerting pressure on the clutch, even if the gearbox is in neutral and the vehicle is stopped. Since the restarting is not instantaneous, the driver tends to maintain pressure on the clutch when he anticipates a short-term stoppage, thus depriving himself of fuel savings.

SUMMARY OF THE INVENTION

The object of the invention is to resolve the disadvantages of the prior art, and for this purpose it relates to a starter for an internal combustion engine, which starter comprises:

an electric motor;

a launcher comprising a pinion which is mobile between a position, known as the free position, in which this pinion is connected in rotation to the said electric motor alone, and a position, known as the meshed position, in which the said pinion is connected in rotation to the electric motor and the internal combustion engine;

an electric switch comprising a main actuator which, when it is engaged, can displace and maintain in position a means, known as the plunger, the said plunger being connected with the displacement of the pinion, between the free position and the meshed position, by a connection means, known as a lever;

means connected to the plunger, known as the contact plate, which can establish electrical power contact between the electric motor and a power source, when the pinion is in the meshed position;

an auxiliary actuator, which, when it is engaged, can open the power contact or prevent the closure of the power contact, and means for controlling the main actuator and the auxiliary actuator separately.

Thus, the starter which is the subject of the invention can be used according to a functioning mode corresponding to that of a starter according to the prior art when the auxiliary actuator is not actuated, and in addition it provides a specific functioning mode in which the pinion of the launcher is meshed, for example with a crown which is connected to the crankshaft of the internal combustion engine, without being driven by the electric motor, and without the said electric motor subjecting the said pinion to resistant torque.

Thus, the pinion can be meshed with the said crown when the internal combustion engine is rotating at reduced speed, in particular in the phase of deceleration of the thermal engine.

Thus, the time for restarting the internal combustion engine is reduced, with the pinion already being engaged, and connected in rotation with the crown.

In addition, in the case of starting of the thermal engine required when the engine is in the balancing phase, since the pinion is already in the crown, it is no longer necessary to wait for the end of stoppage of the thermal engine in order to start the thermal engine, since the pinion is already inserted in the crown.

The invention can be implemented according to the advantageous embodiments described hereinafter, which can be considered individually, or according to any technically operative combination.

Advantageously, the main actuator and the auxiliary actuator are solenoids.

Advantageously, the switch comprises an input terminal which is connected to the power source, and an output terminal which is connected to the electric motor, in particular to the armature, with the contact plate establishing an electrical connection between the input terminal and the output terminal and comprises:

a disconnecting switch, which is actuated by the auxiliary actuator, and establishes additional electrical contact between the plate and the positive terminal of the electric motor.

This embodiment requires little modification of the device according to the prior art, which shares numerous parts with the starter which is the subject of the invention, and thus this embodiment is more particularly advantageous in terms of production cost.

According to a variant of these embodiments, the output terminal is connected electrically to the brushes of the electric motor, and not to the armature.

According to a second variant embodiment of the starter which is the subject of the invention, the switch comprises an input terminal which is connected to the power source, and an output terminal which is connected to the electric motor, the said starter comprising:

a contact plate which is mobile relative to the plunger, according to a degree of freedom which is stopped in contact with the said terminals;

means which are actuated by the auxiliary actuator, and can retain the said plate in contact with one of the terminals by means of a movement according to the said degree of freedom.

According to this embodiment, the auxiliary device, which acts essentially mechanically, is less subject to the phenomena of arcing or adhesion of the contacts. Thus, this embodiment is more advantageous in terms of reliability.

According to an embodiment of this second variant of the starter which is the subject of the invention, the plunger is displaced by the main actuator according to a course in axial translation, and the degree of freedom of the contact plate is a translation parallel to the said course. This embodiment to be produced requires little modification in comparison with a device according to the prior art.

According to another embodiment of the second variant of the starter which is the subject of the invention, the plunger is displaced by the main actuator according to a course in axial translation, and the degree of freedom of the contact plate is a rotation of the axis perpendicular to the axis of the course. This embodiment improves the reliability, since the opening and closure of the contact take place on only one terminal, and it also permits production of a more compact device.

Advantageously, the lever comprises means which allow the pinion to remain in the crown when the latter is at a standstill whilst there is no longer any power supply to the pull-in coil and the hold-in coil. Thus, the pinion of the launcher is retained in the crown of the internal combustion engine when the said engine is stopped, in order to reduce the restarting time.

Advantageously, resilient means act on the means actuated by the auxiliary actuator, thus adding their action to that of the said actuator, in the same sense as that of this actuator when it is engaged. Thus, when the device which is the subject of the invention is at rest, according to this embodiment the auxiliary actuator is in a configuration corresponding to that of the first steps of starting of the internal combustion engine, such that the starting time is reduced.

The invention also relates to a method for functioning of a starter according to one of the embodiments of the invention, the said method comprising the steps consisting of:

obtaining a threshold of speed of rotation of the internal combustion engine, known as the engagement threshold;

obtaining the speed of rotation of the said engine;

if the speed of rotation descends below the engagement threshold, actuating the main actuator and the auxiliary actuator, such as to connect the pinion of the launcher in rotation with the crankshaft of the internal combustion engine;

disengaging the auxiliary actuator and the main actuator;

receiving a request for starting of the thermal engine;

disengaging the main actuator, such as to supply power to the electric motor 150 and rotate the pinion 160 of the launcher; then engaging the main actuator when the internal combustion engine reaches a defined speed of rotation.

Thus, a few milliseconds is gained in the case of conventional starting, since the pinion is already in the crown, and in addition it is possible to reduce the time by one second when the request for starting the thermal engine is implemented whilst the thermal engine is in the balancing phase.

Thus, the pinion of the launcher is pre-engaged integrally in rotation with the internal combustion engine whilst the latter is rotating, and the electric motor does not exert any resistant torque on the said pinion, such that the restarting time of the engine is reduced.

According to an embodiment of the method which is the subject of the invention, a stop command is issued to the thermal engine before step iii., and the engagement threshold is set to 50 rpm. Thus, in the situation of stoppage of an engine, the pinion is engaged at a reduced speed of rotation, such as to limit its wear.

Advantageously, according to this embodiment of the method which is the subject of the invention, when a request for starting is issued before step iv., the said method replaces steps iv, v and vi by a step consisting of:

disengaging the auxiliary actuator such as to supply power to the electric motor 150 and rotate the pinion 160 of the launcher after stoppage of the internal combustion engine, and disengaging the auxiliary actuator, with the pinion being in the engaged position.

Thus, the time perceived by the user for the restarting of the internal combustion engine is reduced to the time for restarting the rotation of the said engine.

According to another embodiment of the method which is the subject of the invention, the engagement threshold is between 500 rpm and 300 rpm. Thus, the pinion of the launcher is systematically engaged, and the restarting takes place as soon as supply of fuel to the engine resumes, in particular as a result of the command by the accelerator. This functioning mode makes it possible to save fuel.

BRIEF DESCRIPTION OF THE DRAWINGS

The invention is described hereinafter according to its preferred embodiments, which are in no way limiting, and with reference to FIGS. 1 to 9, in which.

DETAILED DESCRIPTION

Figure 1:
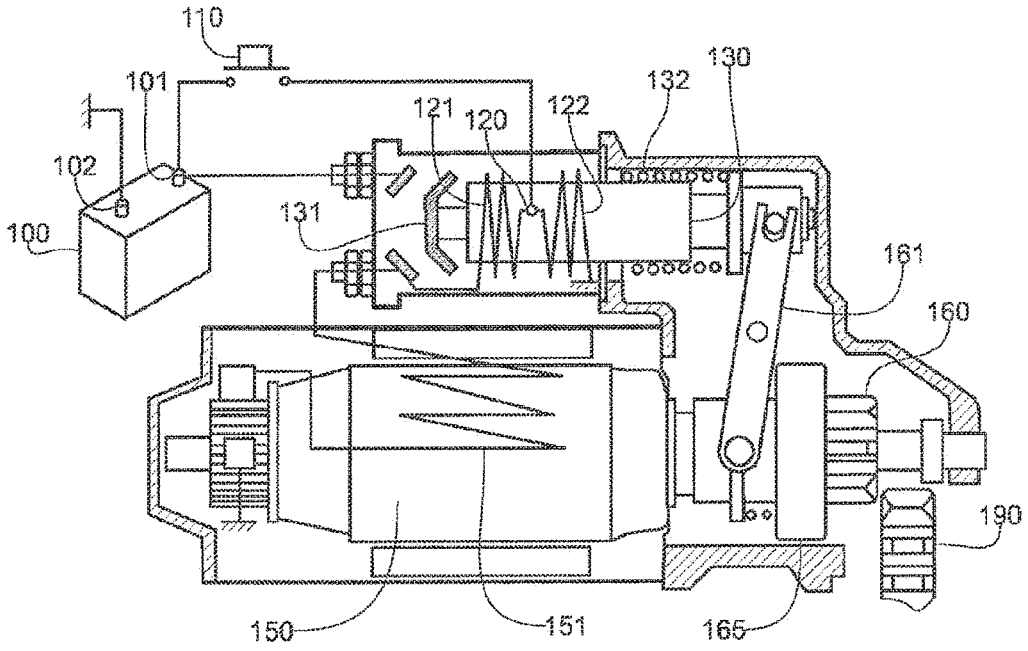
Fig. 1 (Prior Art)
FIG. 1, which relates to the prior art, represents in a view in cross-section of a common embodiment of an electric starter for an internal combustion engine.
Figure 2:
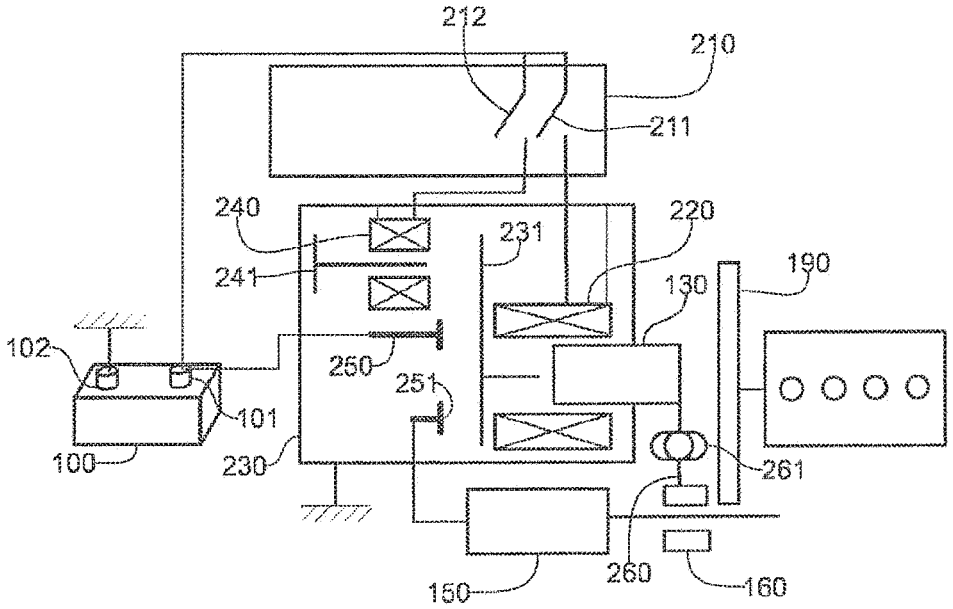
FIG. 2 represents, according to a schematic view corresponding to the same cross-section as that in FIG. 1, an embodiment of the starter which is the subject of the invention, entirely at rest.

According to an embodiment of a starter for an internal combustion engine which is the subject of the invention, in FIG. 2 the starter comprises a control unit 210 comprising two contacts 211, 212, closure of which supplies electrically actuators 220, 240 of a contactor 230. The contactor 230 comprises a plunger 130, the displacement of which is controlled by an actuator 220, known as a main actuator. According to this embodiment, the plunger 130 is connected in translation to the pinion 160 of the launcher by means of a lever 260 and a pivot connection. The lever is supported on the housing of the starter according to a pivot connection and a translation connection perpendicular to the axis of rotation of the pivot connection, known as a sliding pivot connection 261. The pinion can engage the crown 190 of the internal combustion engine. According to this embodiment, when the main actuator 220 is supplied with electrical energy (i.e., energized) by the closure of the corresponding contact 211 of the control module, the actuator gives rise to displacement of the plunger 130, which plunger displaces a contact plate 231, which contact plate can put a supply terminal 251 of an electric motor 150, or output terminal, into electrical communication with a so-called power or input terminal 250 which is connected to an electrical energy source by a battery 100, for example. The electric motor 150 is non-rotatably connected to the pinion 160 in one direction of rotation through the free wheel mechanism 165. When it is supplied electrically, the electric motor 150 of the starter rotates the pinion 160 of the launcher. The contactor 230 also comprises an auxiliary actuator 240, which, when it is supplied electrically (i.e., energized), can isolate the supply terminal 251 of the electric motor 150 from the input terminal 250. The supply to this auxiliary actuator 240 is controlled by a second contact 212 of the control unit 210 of the starter. Thus, according to this embodiment, when the first 211 and the second 212 contacts of the control unit 210 of the starter are closed, the main actuator 220 and the auxiliary actuator 240 are supplied with electrical power (i.e., energized). The engagement of the main actuator 220 has the effect of giving rise to the displacement of the plunger 130, which in this displacement drives the pinion 160 to the engaged position, whereas the engagement of the auxiliary actuator 240 isolates the electric motor 150 from the power supply 250, such that the pinion 160 is not rotated, and does not drive the internal combustion engine 290. On the basis of this situation, the opening of the second contact 212 of the control unit makes it possible to put the electric motor 150 into communication with the power source 100, in this case an accumulator battery 100, and gives rise to the rotation of the pinion 160 of the launcher, which drives the crown 190 of the internal combustion engine 290.

Figure 3:
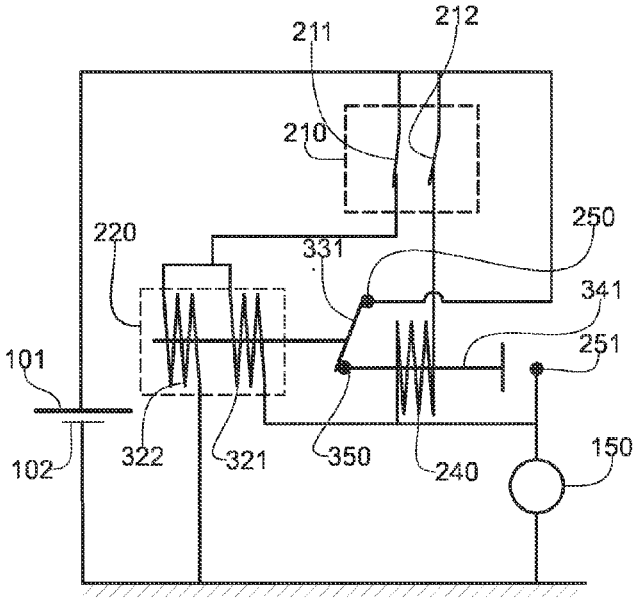
FIG. 3 is an electric flow diagram of an embodiment of an electric starter according to the invention, comprising an intermediate terminal between the input terminal and the output terminal.

According to one embodiment, in FIG. 3, the contact plate 331, which is displaced by the plunger under the effect of the supply of the main actuator 220, establishes the contact between the input terminal 250 connected to the accumulator battery, and an intermediate terminal 352. According to this embodiment, the main actuator comprises a pull-in solenoid 321 and a hold-in solenoid 322. The supply to the auxiliary actuator 240 by means of the closure of the second contact 212 of the control unit 210 displaces means 341, which means, when the auxiliary actuator 240 is not supplied with power, establish electrical contact between the intermediate terminal 352 and the output terminal 251. Thus, according to this embodiment, the auxiliary actuator 240 displaces live means 341.

Figure 4:
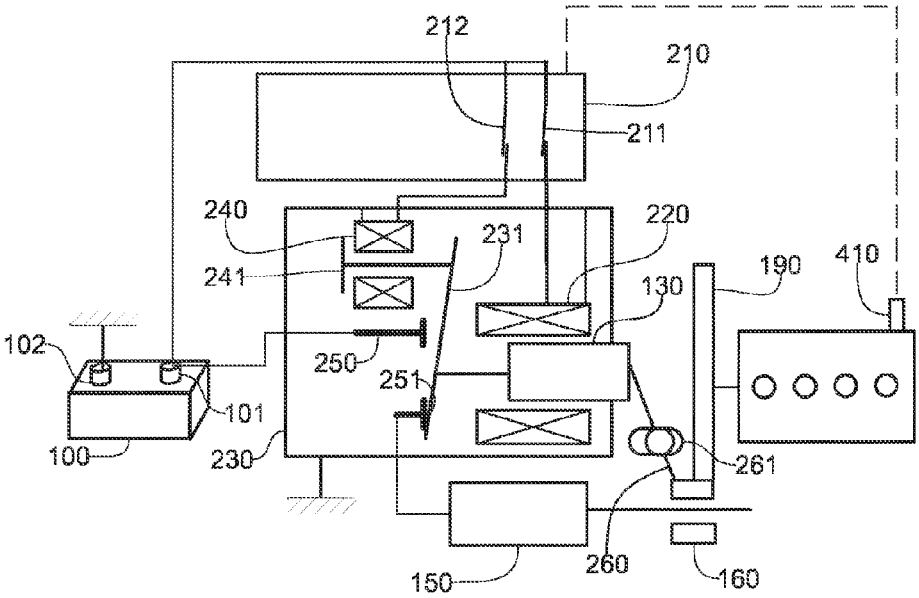
FIG. 4 shows, according to the same view as FIG. 2, an embodiment of the starter which is the subject of the invention, in a configuration in which the auxiliary actuator and the main actuator are engaged.

In FIG. 4, according to another embodiment, corresponding to that in FIG. 2, the contact plate 231 which is displaced by the plunger 130 establishes the contact between the input terminal 250 and the output terminal 251, and the device which is controlled by the auxiliary actuator 240 spaces the said plate 231 from contact with one of these terminals, in this case the input terminal 250, or prevents electrical contact between the said contact plate 231 and one of these terminals, in this case the input terminal 250. Thus, the means 241 prevent contact between the plate 231 and one of the two terminals, in this case 250, thus preventing the supply to the thermal engine. When the second contact 212 of the control unit is open, the auxiliary actuator 240 is no longer supplied with power and return means (not represented), for example in the form of a spring, or the force of the main actuator, displace(s) in the inverse direction the means 241 controlled by the auxiliary actuator 240, thus closing the contact between the input terminal 250 and the output terminal 251. The electric motor 150 is then supplied with power, and rotates the pinion 160 of the launcher. Advantageously, a sensor 410 measures the speed of rotation of the internal combustion engine 290. Thus, when the said engine reaches a speed of rotation which is sufficient to ensure that it is started, for example 1500 rpm, the first contact 211 of the control unit is opened. The actuator 220 is no longer supplied with power, and return means (not represented) thrust the plunger 130 back, such that the contact space 231 is spaced from the terminals 250, 251. The electric motor 150 is no longer supplied with power and stops, and the plunger 130, which resumes its position of rest (FIG. 2) spaces the pinion 160 from the crown 190.

Figure 5:
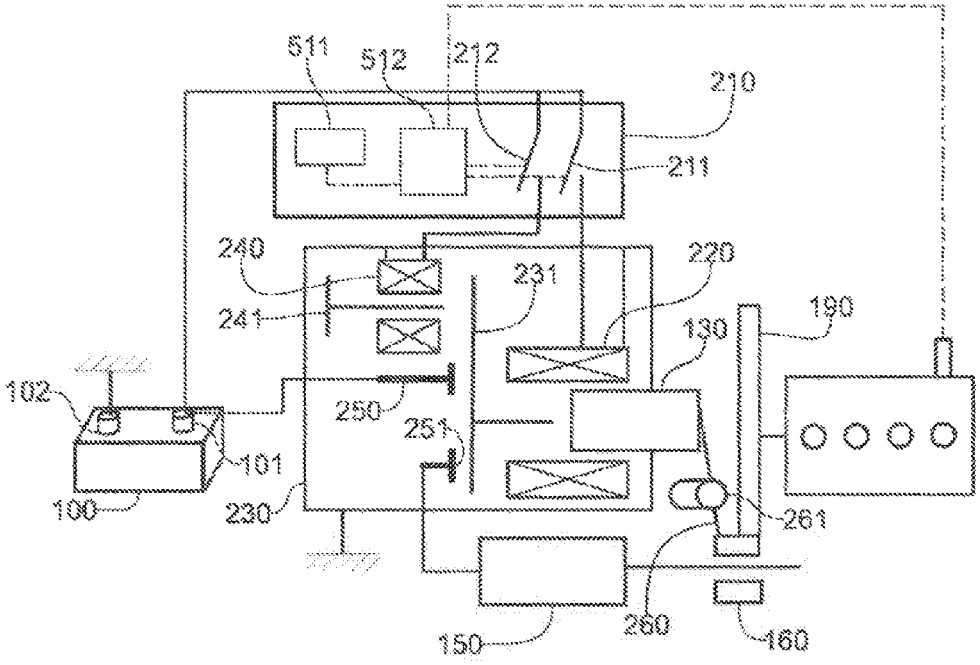
FIG. 5 represents, according to the same view as FIG. 4, the starter which is the subject of the invention in a particular configuration where the actuators are disengaged, but the pinion of the launcher remains engaged with the crown of the crankshaft of the internal combustion engine.

In FIG. 5, if, starting from the situation in FIG. 4, the two contacts 211, 212 of the control unit are opened simultaneously, then the contact plate 231 is spaced from the input 250 and output 251 terminals, and the plunger 130 and the means 241 for displacement of the auxiliary actuator 240 resume their position of rest (FIG. 2) under the effect of their respective return means (not represented), and because of the rotation of the crown of the thermal engine. If at this moment the internal combustion engine 290 is at a standstill, the resistant torque of this engine prevents the extraction of the pinion 160 with helical toothing from being meshed with the crown 190. The sliding pivot connection 261 of the lever 260 then allows the pinion to remain engaged with the crown, whereas the plunger is no longer retained in its active position by means of the forces generated by the solenoids, which are also known as the pull-in coil or hold-in coil. This therefore makes it possible to leave the pinion in the crown when the starter is no longer supplied electrically, i.e. with the contacts 211 and 212 open. Thus, the further closure of the first contact 211 of the control unit makes it possible to launch the internal combustion engine directly. According to this embodiment, the control unit 210 comprises memory means 511 in which there are recorded different threshold values of the speed of rotation of the engine. The control unit also comprises a computer 512 comprising an input port for the acquisition of information such as:

the speed of rotation of the internal combustion engine;

the state of control of the supply of fuel to the internal combustion engine;

the state of a start/stop contact of the engine.

The said computer 512 also comprises an output port to control the two contacts 211, 212 of the control unit separately.

Figure 6:
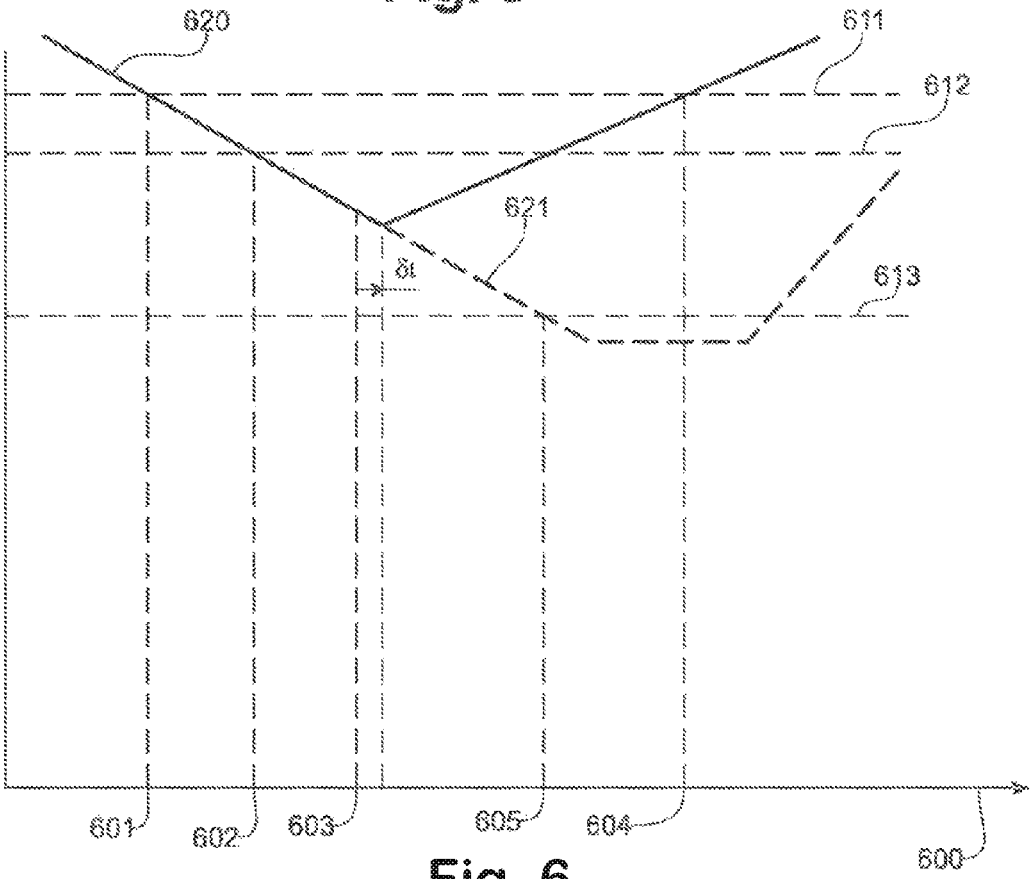
FIG. 6 is a diagram showing on a time basis scenarios of deceleration of the internal combustion engine, with restarting of the engine by the electric motor of the starter which is the subject of the invention.

In FIG. 6, on a time basis 600, when the speed of rotation of the engine approaches a first threshold speed, known as the monitoring speed 611, corresponding substantially to the idling speed of the said engine, for example 800 rpm, the computer of the control unit is on standby and monitors the successive events, in order to optimise the speed of restarting of the vehicle, according to scenarios recorded in the memory means.

Thus, for example, when the starter which is the subject of the invention is installed in a motor vehicle, in the case when the driver of the said vehicle releases the accelerator pedal, if the speed of rotation 620 of the internal combustion engine goes below a threshold, known as the first threshold 612, for example 500 rpm, the internal combustion engine cannot restart by itself. On the other hand, if the speed of rotation of the said engine remains higher than this threshold, the restoration of the fuel supply to the engine allows it to restart. Thus, according to a first sequence of development 620 of the speed of rotation of the internal combustion engine, with the driver having released the accelerator pedal, the fuel supply is cut off, the speed of rotation 620 of the engine decreases, and after a first stage 601 the monitoring speed 611 is reached. The driver does not resume the acceleration, and at the end of a second stage 602, the speed of rotation of the engine reaches the first threshold 612. If, in a third stage 603, the driver restarts the acceleration, with the computer of the control unit having received the information that the first threshold 612 has been passed, during this third stage 603 it closes the contact 211, i.e. it closes the contact between the plate and the terminal 250 for the embodiment in FIG. 4, and closes the contacts between the terminals 250 and 251 for the embodiment in FIG. 3. Thus, the pinion of the launcher is engaged with the crown. When the speed of rotation of the internal combustion engine reaches a safety threshold 611, the first contact 211 of the control unit is opened, which returns the plunger, disengages the pinion from the launcher, and stops the rotation of the thermal engine.

According to another scenario 621 of development of the speed of rotation of the engine, the driver does not re-accelerate, and the speed of rotation of the internal combustion engine goes below a third threshold 613, known as the engagement threshold, for example 50 rpm. In these conditions, when this threshold 605 has been exceeded, the computer closes the two contacts 211 and 212 of the control unit, which has the effect of engaging the pinion with the crown. The introduction of the said pinion at this lower speed of rotation limits the wear of the said pinion. When there is a starting request, for example when the driver re-accelerates, or the contact 210 is engaged, the process opens the contact 212, which permits very rapid restarting during the balancing phase. According to a preferred embodiment, during the balancing phase, i.e. when the engagement threshold has been exceeded, after a time $\delta t$ necessary in order to ensure that the pinion is engaged in the crown, the computer opens the second contact, which has the effect of rotating the electric motor of the starter, and restarting the internal combustion engine.

When the thermal engine is at a standstill, i.e. when the crankshaft of the thermal engine is at a standstill, then the two contacts of the control unit are opened, and the pinion continues to be engaged with the crown when the vehicle stops.

Figure 7:
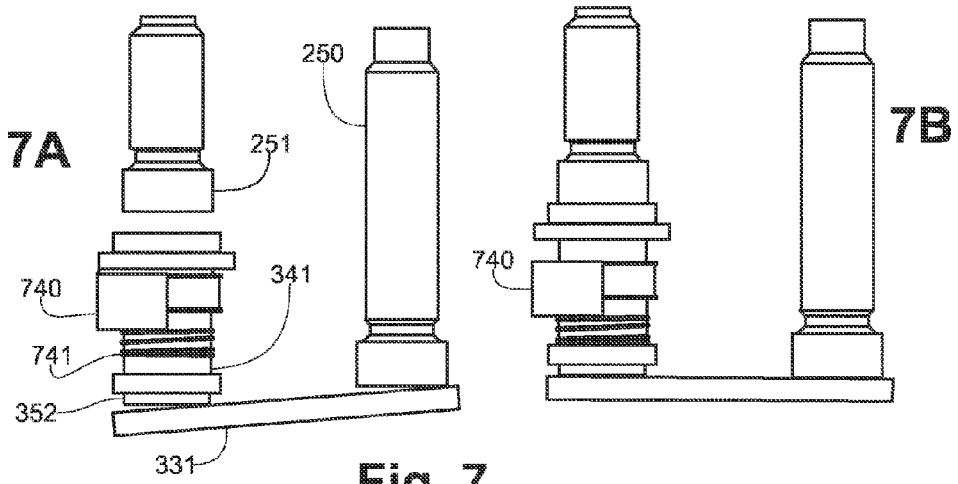
FIG. 7 shows, according to a partial front view, an embodiment of the auxiliary actuator according to the embodiment corresponding to FIG. 3, of the starter which is the subject of the invention.

In FIG. 7, according to an embodiment of the auxiliary actuator corresponding to the embodiment represented in FIG. 3 of the starter which is the subject of the invention, the means 341 is displaced by a micro-solenoid 740, and returned to position by a helical spring 741 which forms a return means.

Figure 8:
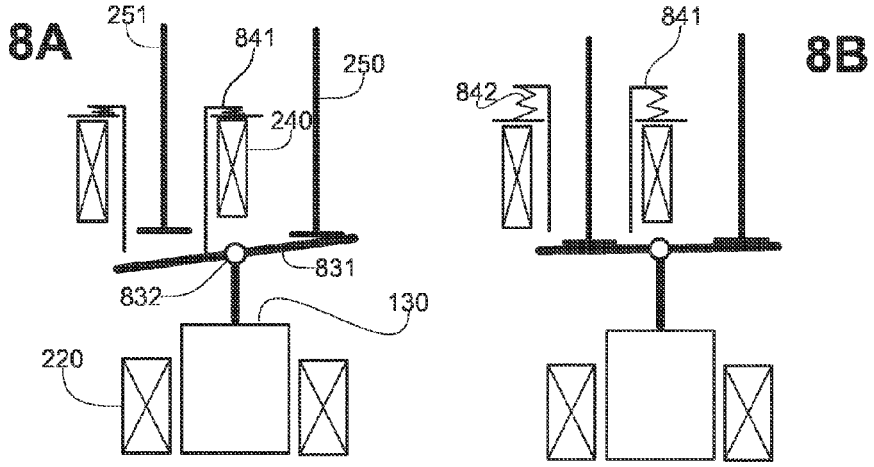
FIG. 8 shows schematically, according to the same view as FIG. 7, an embodiment of the auxiliary actuator of a starter corresponding to the embodiment of the invention according to FIG. 2.

In FIG. 8, according to an embodiment of the auxiliary actuator corresponding to the embodiment in FIG. 2 of the starter which is the subject of the invention, a micro-solenoid 240 commands the displacement of a ring 841 which is substantially concentric relative to the output terminal 251. The contact plate 831 is displaced in translation towards the terminals 251, 250 by the plunger 130, and is articulated according to a pivot connection 832 with an axis substantially perpendicular to the said direction of displacement in translation, for example by means of play between a hole in the plate 831 and a control rod which displaces the plate which passes through this hole. When power is supplied to the micro-solenoid 240, the ring 841 prevents the said contact plate 831 from being in contact with the output terminal 251, or spaces the plate 831 from the terminal 251. When power is no longer supplied to the micro-solenoid 240 of the auxiliary actuator, return means 842 thrust back the ring 841, which then permits contact of the plate 831 with the output terminal 251. According to this embodiment, the ring comprises a part which is preferably metal, in order to be able to be displaced by the micro-solenoid, but the end of the ring 841 which is in contact with the contact plate 831 is electrically isolated.

Figure 10:
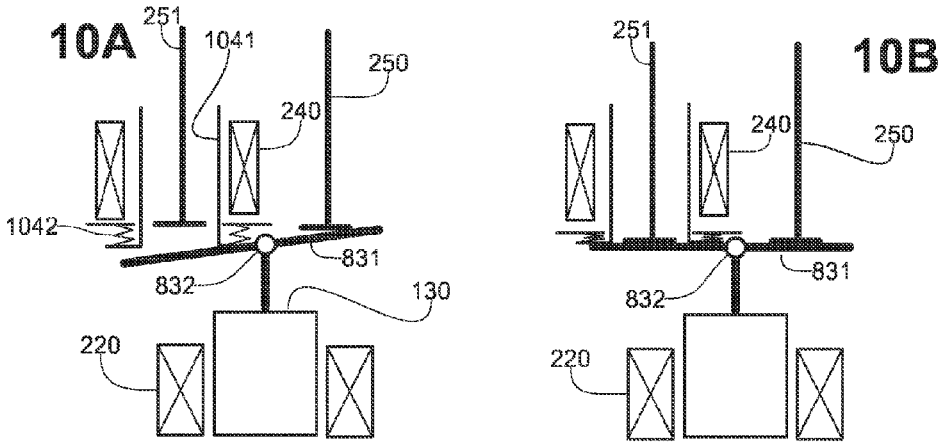
FIG. 10 represents, according to the same view as FIG. 8, an alternative embodiment of the auxiliary actuator.

According to another embodiment represented in FIG. 10, when power is supplied to the micro-solenoid 240, the ring 1041 in the activated position prevents the said contact plate 831 from being in contact with the output terminal 251. When power is no longer supplied to the micro-solenoid 240 of the auxiliary actuator, by means of the plunger 130 and the plate 831 the main actuator thrusts the ring 1041 into the deactivated position, which then permits contact of the plate 831 with the output terminal 251. According to this embodiment, the micro-solenoid 240 preferably comprises a spring 1042 to return the ring 1041 to the activated position, firstly in order to ensure that the ring prevents contact between the plate 831 and the output terminal 251, and secondly in order to attenuate the vibrations in the state of rest. In an identical manner, the ring comprises a part which is preferably metal, in order to be able to be displaced by the micro-solenoid, but the end of the ring 1041 which is in contact with the contact plate 831 is electrically isolated.

In FIG. 10A, the ring 1041 is thrust towards the contact plate 831 by a spring 1042 and the action of the micro-solenoid 240, thus spacing the said plate 831 from contact with the output terminal 251. In FIG. 10B, since power is no longer supplied to the micro-solenoid 240, the action of the plunger 130 thrusts the ring 1041 back, thus compressing the springs 1042, and permitting closure of the contact between the input terminal 250 and the output terminal 251.

According to another example of the two embodiments previously described, the auxiliary actuator does not comprise its ring around the input terminal, but around the output position. In this embodiment, the ring prevents contact between the plate and the input terminal.

Figure 9:
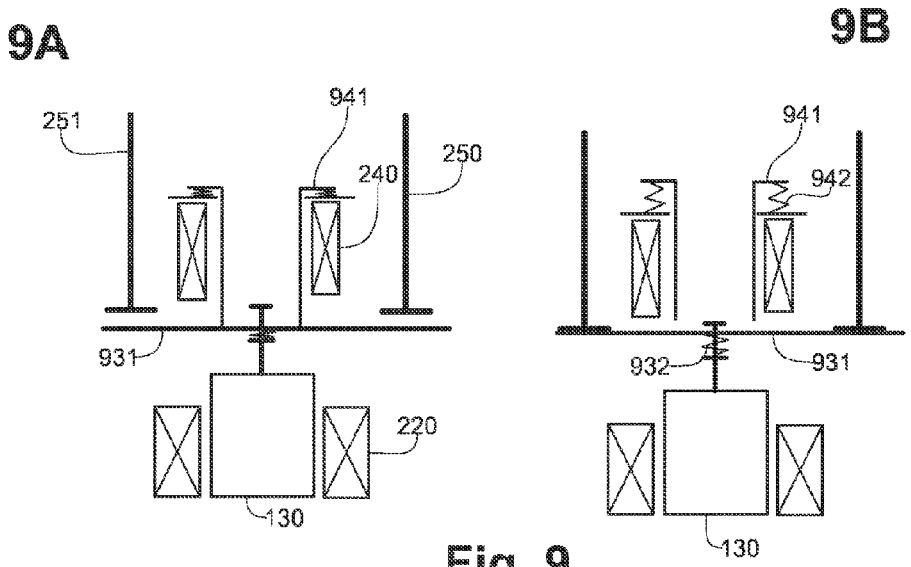
FIG. 9, represents according to the same view as FIG. 8, an alternative embodiment of the auxiliary actuator.

In FIG. 9, according to another embodiment of the auxiliary actuator corresponding to the embodiment in FIG. 2 of the starter which is the subject of the invention, a micro-solenoid 240 commands the displacement of a ring 941, which is placed between the input terminal 250 and the output terminal 251. Under the action of the solenoid 220 of the main actuator, the plunger displaces the contact plate 931 in translation towards the said terminals 250, 251. The said contact plate 931 comprises a degree of freedom in translation parallel to the direction of displacement of the plunger, and return means 932 which tend to thrust the contact plate towards the terminals 251, 252. The power supply to the micro-solenoid 240 of the auxiliary actuator prevents the contact plate 931 from being in contact with the terminals 250 and 251 by means of the ring 941. When the supply to the said micro-solenoid is cut-off, return means 942 give rise to withdrawal of the ring 941, and the return means 932 of the contact plate 931 thrust the said plate into contact with the terminals. Thus, according to this embodiment, the ring 941 is not in contact with the plate 931 when the latter is in contact with the input terminal.

Figure 11:
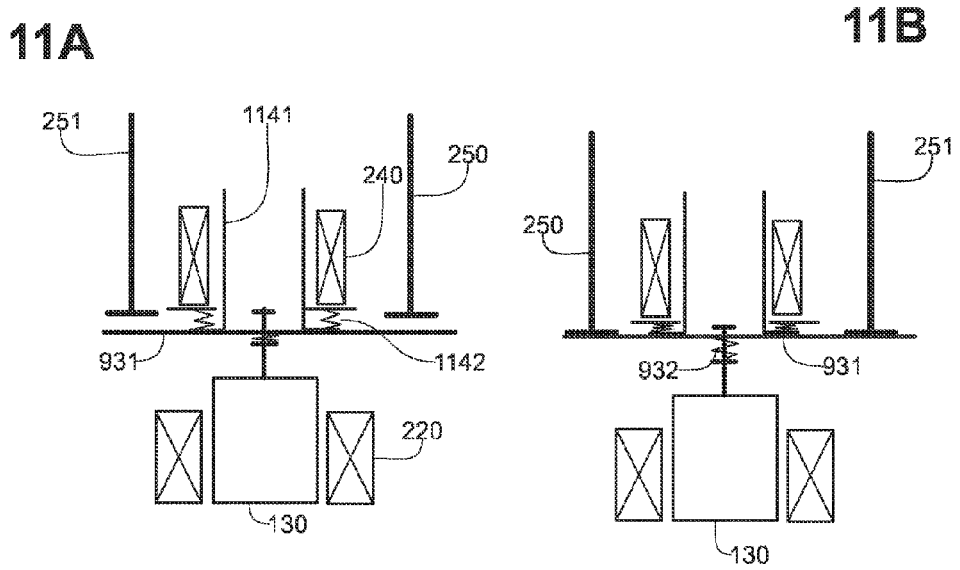
FIG. 11 represents, according to the same view as FIG. 8, an alternative embodiment of the auxiliary actuator.

According to another embodiment represented in FIG. 11, when power is supplied to the micro-solenoid 240, the ring 1141 in the activated position prevents the said contact ring 831 from being in contact with the terminals 251 and 250. When power is no longer supplied to the micro-solenoid 240 of the auxiliary actuator, by means of the plunger 130 and the plate 931 the main actuator thrusts the ring 1141 into the deactivated position, which then permits contact of the plate 931 with the two terminals 251 and 250. According to this embodiment, the micro-solenoid 240 preferably comprises a spring 1142 to return the ring 1141 to the activated position, firstly in order to guarantee that the ring prevents contact between the plate 931 and one or both terminals 250, 251, and secondly in order to attenuate the vibrations in the state of rest. In this embodiment, in the deactivated position, the ring is in contact with the plate. The ring comprises a part which is preferably metal, in order to be able to be displaced by the micro-solenoid, but the end of the ring 841 which is in contact with the contact plate 831 is electrically isolated.

In a similar manner, in FIG. 11A, when power is supplied to the micro-solenoid 240, its action is added to that of the spring 1142, and thrusts the ring 1141, which spaces the contact plate 931 from the terminals. In FIG. 11B, when power is no longer supplied to the micro-solenoid 240, the action of the plunger 130 thrusts the ring 1141 back, thus compressing the spring 1142.

The embodiments represented in FIG. 10 and FIG. 11 have the advantage that, in the absence of an electrical supply, the action of the springs 1042, 1142 acting on the auxiliary actuator 1041, 1042 tends to open the contact between the terminals. Thus, in the starting sequence of the engine, the auxiliary actuator is by default in the configuration designed for concatenation of the steps, such as to reduce the starting time further still.

The foregoing description and the examples of embodiments show that the invention achieves the objectives set out. In particular, it makes it possible to reduce the restarting time of an internal combustion engine, by pre-engaging the pinion of the launcher whilst the said combustion engine is still rotating.

The invention claimed is:

1. A starter for an internal combustion engine (290), the starter comprising:

a) an electric motor (150);

b) a launcher comprising a pinion (160) which is mobile between a free position, in which the pinion is connected in rotation to the electric motor (150) alone, and a meshed position, in which the pinion (160) is connected in rotation to the electric motor (150) and the internal combustion engine (290);

c) an electric switch (230) comprising a main actuator (220) which, when energized, can displace and maintain in position a plunger (130), the plunger being connected with the displacement of the pinion (160), between the free position and the meshed position, by a lever (260);

d) a contact plate (231, 331, 831, 931) connected to the plunger (130), the contact plate (231, 331, 831, 931) configured to establish electrical power contact between the electric motor (150) and a power source (100), when the pinion (160) is in the meshed position;

e) the electric switch (230) further including an auxiliary actuator (240), which, when energized, can open the power contact or prevent the closure of the power contact; and f) a control unit (211, 212, 512) for controlling the main actuator (220) and the auxiliary actuator (240) separately.

2. The starter according to claim 1, wherein the main actuator (240) and the auxiliary actuator (220) are solenoids.

3. The starter according to claim 2, wherein the plunger (130) is displaced by the main actuator (220) according to a course in axial translation, and wherein the degree of freedom of the contact plate (931) is a translation parallel to the course.

4. The starter according to claim 2, wherein the plunger (130) is displaced by the main actuator according to a course in axial translation, and wherein the degree of freedom of the contact plate (831) is a rotation of the axis perpendicular to the axis of the course.

5. The starter according to claim 2, wherein the lever (260) comprises means (261) allowing the pinion to remain in the crown when the latter is at a standstill whilst there is no longer any power supply to the main actuator (220).

6. The starter according to claim 1, wherein the switch comprises an input terminal (250) which is connected to the power source (100), and an output terminal (251) which is connected to the electric motor (150), with the contact plate (331) establishing an electrical connection between the input terminal and the output terminal, and it comprises:

a) a disconnecting switch (341), which is actuated by the auxiliary actuator (240), and establishes an additional electrical contact between the plate (331) and the positive terminal (251) of the electric motor.

7. The starter according to claim 6, wherein the plunger (130) is displaced by the main actuator (220) according to a course in axial translation, and wherein the degree of freedom of the contact plate (931) is a translation parallel to the course.

8. The starter according to claim 6, wherein the plunger (130) is displaced by the main actuator according to a course in axial translation, and wherein the degree of freedom of the contact plate (831) is a rotation of the axis perpendicular to the axis of the course.

9. The starter according to claim 6, wherein the lever (260) comprises means (261) allowing the pinion to remain in the crown when the latter is at a standstill whilst there is no longer any power supply to the main actuator (220).

10. The starter according to claim 1, wherein the switch comprises an input terminal (250) which is connected to the power source (100), and an output terminal (251) which is connected to the electric motor (150), the starter comprising:

a) a contact plate (231, 831, 931) mobile relative to the plunger (130), according to a degree of freedom which is stopped in contact with the terminals (250, 251);

b) means (241, 841, 941) actuated by the auxiliary actuator (240), and configured to retain the plate (231, 831, 931) in contact with one of the terminals (250, 251) by means of a movement according to the degree of freedom.

11. The starter according to claim 10, wherein the plunger (130) is displaced by the main actuator according to a course in axial translation, and wherein the degree of freedom of the contact plate (831) is a rotation of the axis perpendicular to the axis of the course.

12. The starter according to claim 10, wherein the lever (260) comprises means (261) allowing the pinion to remain in the crown when the latter is at a standstill whilst there is no longer any power supply to the main actuator (220).

13. The starter according to claim 1, wherein the plunger (130) is displaced by the main actuator (220) according to a course in axial translation, and the degree of freedom of the contact plate (931) is a translation parallel to the course.

14. The starter according to claim 13, wherein the plunger (130) is displaced by the main actuator according to a course in axial translation, and wherein the degree of freedom of the contact plate (831) is a rotation of the axis perpendicular to the axis of the course.

15. The starter according to claim 13, wherein the lever (260) comprises means (261) allowing the pinion to remain in the crown when the latter is at a standstill whilst there is no longer any power supply to the main actuator (220).

16. The starter according to claim 1, wherein the plunger (130) is displaced by the main actuator according to a course in axial translation, and the degree of freedom of the contact plate (831) is a rotation of the axis perpendicular to the axis of the course.

17. The starter according to claim 16, wherein the lever (260) comprises means (261) allowing the pinion to remain in the crown when the latter is at a standstill whilst there is no longer any power supply to the main actuator (220).

18. The starter according to claim 1, wherein the lever (260) comprises means (261) allowing the pinion to remain in the crown when the latter is at a standstill whilst there is no longer any power supply to the main actuator (220).

19. A method for stopping the functioning of a starter for an internal combustion engine (290), the starter comprising:

a) an electric motor (150);

b) a launcher comprising a pinion (160) which is mobile between a free position, in which the pinion is connected in rotation to the electric motor (150) alone, and a meshed position, in which the pinion (160) is connected in rotation to the electric motor (150) and the internal combustion engine (290);

c) an electric switch (230) comprising a main actuator (220) which, when energized, can displace and maintain in position a plunger (130), the plunger being connected with the displacement of the pinion (160), between the free position and the meshed position, by a lever (260);

d) a contact plate (231, 331, 831, 931) connected to the plunger (130), the contact plate (231, 331, 831, 931) configured to establish electrical power contact between the electric motor (150) and a power source (100), when the pinion (160) is in the meshed position;

e) the electric switch (230) further including an auxiliary actuator (240), which, when energized, can open the power contact or prevent the closure of the power contact; and f) a control unit (211, 212, 512) for controlling the main actuator (220) and the auxiliary actuator (240) separately;

the method comprising the steps of:

i) obtaining an engagement threshold (612, 613) of speed of rotation of the internal combustion engine;

ii) obtaining the speed of rotation of the engine;

iii) if the speed of rotation descends below the engagement threshold (612, 613), actuating the main actuator (220) and the auxiliary actuator, such as to connect the pinion (160) of the launcher in rotation with the crankshaft of the internal combustion engine (290);

iv) deactivating the main actuator and the auxiliary actuator when the thermal engine is at a standstill;

v) receiving a request for starting of the thermal engine;

vi) engaging the main actuator, such as to supply power to the electric motor (150) and rotate the pinion (160) of the launcher; then vii) disengaging the main actuator (604) when the internal combustion engine reaches a defined speed (611) of rotation.

20. The method according to claim 19, wherein a stop command is issued to the thermal engine before the third step, and the engagement threshold (613) is set to 50 rpm.

21. The method according to claim 19, wherein, when a starting request is made before the fourth step, the method replaces the third, fourth, fifth and sixth steps by the steps of:

i) if the speed of rotation is below the engagement threshold (612, 613), actuating the main actuator (220) and the auxiliary actuator (240) such as to connect the pinion (160) of the launcher in rotation with the crankshaft of the internal combustion engine (290); then disengaging the auxiliary actuator such as to supply power to the electric motor (150) and rotate the pinion (160) of the launcher, the pinion (160) remaining in the meshed position;

ii) if the speed of rotation is above the engagement threshold, actuating the main actuator (220) such as to connect the pinion (160) of the launcher in rotation with the crankshaft of the internal combustion engine (290).

22. The method according to claim 21, wherein the step of requesting starting is made before 300 rpm, and waiting for the thermal engine to reach 300 rpm in order to actuate the main actuator (220).

* * * * *